US006481352B2

(12) United States Patent
Mayer et al.

(10) Patent No.: US 6,481,352 B2
(45) Date of Patent: Nov. 19, 2002

(54) METHOD FOR CONTROLLING A QUANTITY OF INK IN AN INKING UNIT

(75) Inventors: Martin Mayer, Ladenburg; Nikolaus Pfeiffer, Heidelberg, both of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 14 days.

(21) Appl. No.: 09/730,270

(22) Filed: Dec. 5, 2000

(65) Prior Publication Data

US 2001/0037740 A1 Nov. 8, 2001

(30) Foreign Application Priority Data

Dec. 6, 1999 (DE) ..... 199 58 653

(51) Int. Cl.[7] ..... B41F 31/12

(52) U.S. Cl. ..... 101/484; 101/350.3; 101/351.1; 101/350.4; 101/DIG. 32

(58) Field of Search ..... 101/350.3, 350.4, 101/350.6, 351.1, 351.3, 365, 364, 367, 484, DIG. 32, DIG. 47

(56) References Cited

U.S. PATENT DOCUMENTS 3,908,545 A * 9/1975 Simeth ..... 101/350.4
5,170,711 A 12/1992 Maier et al. ..... 101/365
5,590,599 A * 1/1997 Muller et al. ..... 101/365
6,112,660 A 9/2000 Junghans et al. ..... 101/350.3
6,227,113 B1 * 5/2001 Dorenkamp ..... 101/348

FOREIGN PATENT DOCUMENTS

GB 2 193 926 A * 2/1988

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A method for controlling the ink quantity in an inking unit of a printing machine by a predetermined nominal value, using a vibrator roller oscillating between a fountain roller and the inking unit, and picking up an ink portion and surrendering it to the inking unit with which the vibrator roller is in contact, includes varying the width of an ink stripe on the vibrator roller, depending upon the nominal value, by adjusting the size of the transferred ink portion, for a modification in the nominal value, from a size ($F_I$) corresponding to the nominal value prior to modification, to at least one intermediate size ($F_z$) lying beyond a size ($F_x$) corresponding to the modified nominal value and, subsequent to the expiration of a transition time interval ($[t_1,t_2]$), adjusting the intermediate size ($F_z$) of the ink portion back to the size ($F_x$) thereof corresponding to the modified nominal value.

10 Claims, 4 Drawing Sheets

METHOD FOR CONTROLLING A QUANTITY OF INK IN AN INKING UNIT

BACKGROUND OF THE INVENTION

Field of the Invention

The invention relates to a method for controlling a quantity of ink in an inking unit of a printing machine using a predetermined nominal or desired value.

For metering ink into the inking unit of a printing machine, ink fountains or ducts have become known heretofore which include a fountain or duct roller, also called a ductor, that rotates in contact with fluid ink and a number of doctor blades disposed adjacent one another in the longitudinal direction of the fountain roller, the positioning of the doctor blades at the fountain roller being controllable by actuators, so that the doctor blades adjust the thickness of the ink layer, which is removed from the ink bath by the fountain roller, to a separately definable value for each individual zone.

A vibrator roller performs an oscillating movement wherein, in a first end position thereof, it engages the fountain roller in such a way that the ink layer located thereon is transferred to the vibrator roller, and in a second end position thereof, it engages an inking unit roller so as to transfer the ink portion that is picked up by the fountain roller, onto the inking unit roller.

The ink flow, i.e., the quantity of ink per unit of time, with which the inking unit is supplied, thus derives from the number of ink portions that are transferred per unit of time, and the size of each individual ink portion is determined by the thickness of the ink layer on the fountain roller (which may differ from zone to zone) and the size of the portion of the surface area of the vibrator roller that comes into contact with the fountain roller in the course of a cycle of the oscillating motion.

In the context of supplying ink to individual zones of the inking unit of a printing machine, it has been known heretofore always to overcontrol the ink supply of the affected zone when the ink quantity in this zone is changed. This means that when the desired quantity of ink for the zone is changed, the thickness of the ink layer that is appropriate in order to maintain the desired ink quantity in continuous operation is not immediately set on the fountain roller; rather, when the modification calls for an increase or a reduction of the ink quantity, a temporary value of the ink layer thickness is initially set, which is larger and smaller, respectively, than that which would be required in order to maintain the desired ink quantity in continuous operation.

But this method only functions when the desired modification of the ink quantity, including the overcontrol, can be achieved by adjusting the layer thickness on the fountain roller, for example, by an electronic ink zone control such as the aforementioned control of the positioning of the doctor blades against the fountain roller.

SUMMARY OF THE INVENTION

It is accordingly an object of the invention to provide a method for controlling an ink quantity in an inking unit by which it is also possible to make very large adjustments in the ink quantity within a short time period. Another object of the invention is to provide such a method by which an acceleration of the inking unit response is achieved, even when the ink fountains are without electronic ink zone control.

With the foregoing and other objects in view, there is provided, in accordance with the invention, a method for controlling the ink quantity in an inking unit of a printing machine by a predetermined nominal value, using a vibrator roller oscillating between a fountain roller and the inking unit, and picking up an ink portion and surrendering it to the inking unit with which the vibrator roller is in contact, which comprises varying the width of an ink stripe on the vibrator roller, depending upon the nominal value, by adjusting the size of the transferred ink portion, for a modification in the nominal value, from a size ($F_I$) corresponding to the nominal value prior to modification, to at least one intermediate size ($F_z$) lying beyond a size ($F_x$) corresponding to the modified nominal value and, subsequent to the expiration of a transition time interval ($[t_1,t_2]$), adjusting the intermediate size ($F_z$) of the ink portion back to the size ($F_x$) thereof corresponding to the modified nominal value.

In accordance with another mode of the method, the difference ($F_u$) between the intermediate size ($F_z$) and the size ($F_I$) corresponding to the nominal value prior to the modification thereof is proportional to the difference between the size ($F_I$) corresponding to the nominal value prior to modification thereof and the size ($F_x$) corresponding to the modified nominal value.

In accordance with a further mode of the method, the proportionality factor is between 1.5 and 2.5.

In accordance with an added mode, the method invention includes modifying the width of the ink stripe so as to adjust the ink portion between the size ($F_x$) corresponding to the modified nominal value and the intermediate size ($F_z$).

In accordance with an additional mode, the method includes modifying the thickness of the ink layer on the ink stripe so as to adjust the ink portion between the size ($F_x$) corresponding to the modified nominal value and the intermediate size ($F_z$).

In accordance with yet another mode, the method includes zonally controlling the thickness of the ink on the ink stripe.

In accordance with yet a further mode, the method includes zonally prescribing the ratio of the difference between the intermediate size ($F_z$) and the size ($F_I$) corresponding to the nominal value prior to the modification, to the difference between the size ($F_I$) corresponding to the nominal value prior to modification and the size ($F_x$) corresponding to the modified nominal value.

In accordance with yet an added mode, the method includes prescribing the ratio smaller, the larger the area is that is covered by the zone that is being controlled.

In accordance with yet an additional mode, the method includes modifying the duration of contact between the fountain roller and the vibrator roller so as to modify the width of the ink stripe.

In accordance with a concomitant mode, the method includes modifying the rate of rotation of the fountain roller so as to modify the width of the ink stripe.

It has proven expedient herein to select the difference between the temporary size of the ink portion and the size that corresponds to the nominal value prior to modification so as to be proportional to the difference between the size of the ink portion corresponding to the nominal value prior to modification and the size of the ink portion corresponding to the modified nominal value. The proportionality factor preferably is between 1.5 and 2.5. This means that the temporary size is overcontrolled compared to the size corresponding to the modified nominal value by a factor of 1.5 to 2.5.

While the modification of the ink portion from the size thereof corresponding to the nominal value prior to modification to the corresponding size thereof subsequent to modification is always accomplished by varying the width of the ink stripe, there are two logical methods for changing the size of the ink portion between the size corresponding to the modified nominal value and the temporary size. The first provides for a modification of the width of the ink stripe on the vibrator roller; i.e., the length along which the fountain roller and the vibrator roller engage one another in the course of a movement cycle of the vibrator roller is varied. This possibility also exists in machines with ink fountains without zonal control of the ink blades. The other possibility is to vary the thickness of the ink stripe that is transferred by the vibrator roller, so that, given a constant width of the ink stripe, portions of varying sizes can be transferred. Modification of the thickness is expediently accomplished by adjusting doctor blades that rest at the fountain roller, which determine the thickness of the ink layer that the fountain roller extracts from an ink fountain. This alternate embodiment can advantageously be used with ink fountains having zonally controllable blades.

It is particularly advantageous here, if the thickness of the ink stripe is controlled zonally. This makes it possible to stipulate the extent of the overcontrol separately for each zone and, for example, to select a greater overcontrol factor for a zone with a small area coverage compared to zones with larger area coverage.

Of course, the two aforementioned possibilities for modifying the size of the ink portion can also be combined. Thus, for example, it is imaginable that both the thickness of the ink stripe and the width are varied in an individual adjustment of the ink portion from the size corresponding to the modified nominal value to the temporary size, or the reverse. It would also be conceivable to perform an adjustment from the size corresponding to the modified nominal value to the temporary size by changing the width, and to perform the counteradjustment in the opposite direction by varying the thickness of the ink stripe, or the reverse, if this simplifies the control or proves otherwise expedient.

The width of the ink stripe can be influenced by shortening or lengthening the phase within the movement cycle of the vibrator roller wherein the vibrator roller is in contact with the fountain roller. Manipulation of the rate of rotation of the fountain roller is a particularly advantageous way to modify the width of the ink stripe, because this is easy to control. In this case, the width of the ink stripe that is generated on the vibrator roller during a constant contact period is approximately directly proportional to the rate of rotation of the fountain roller. The rate of rotation of the fountain roller can be selected quite freely, without having any effect on the functioning of the inking unit that is connected downline.

Other features which are considered as characteristic for the invention are set forth in the appended claims.

Although the invention is illustrated and described herein as a method for controlling a quantity of ink in an inking unit, it is nevertheless not intended to be limited to the details shown, since various modifications and structural changes may be made therein without departing from the spirit of the invention and within the scope and range of equivalents of the claims.

The method of operation of the invention, however, together with additional objects and advantages thereof will be best understood from the following description of specific modes of the method when read in connection with the accompanying drawings, wherein:

DESCRIPTION OF THE PREFERRED EMBODIMENTS

Figure 1:
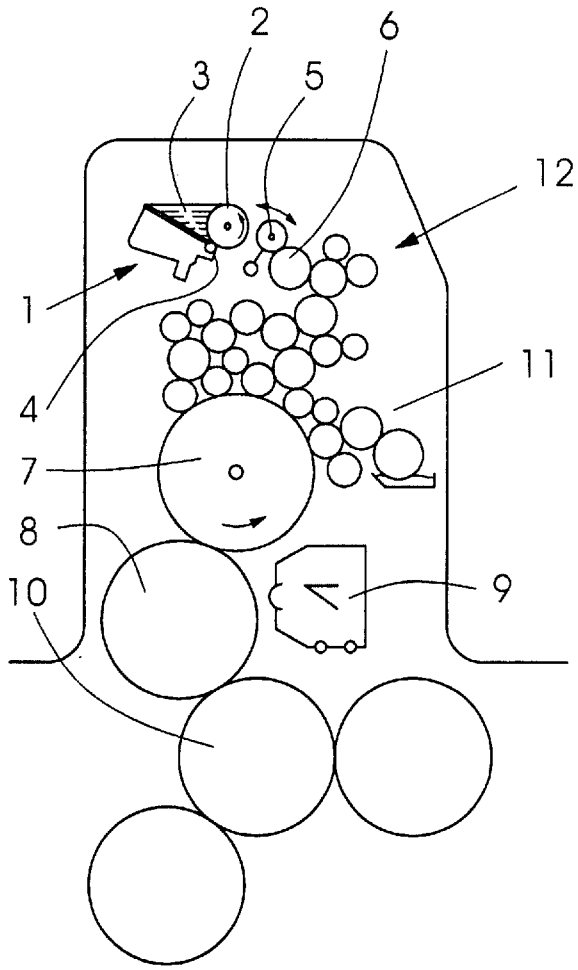
FIG. 1 is a diagrammatic side elevational view of a printing unit of a printing machine, which is suitable for performing the method according to the invention.

Referring now to the drawings and, first, particularly to FIG. 1 thereof, there is shown therein, in a fragmentary diagrammatic view of a printing machine, a printing unit for performing the method according to the invention. The printing unit has an ink fountain 1 as an ink source, which includes a fountain roller 2 that rotates in contact with an ink bath 3 and is thereby wetted with the ink. A plurality of doctor blades 4 are disposed at a sidewall of the ink fountain 1. The doctor blades 4 define a gap, referred to as an ink zone opening, between themselves, on the one hand, and the surface of the fountain roller 2, on the other hand. The gap determines the thickness of the ink layer that is extracted from the ink fountain by the fountain roller 2. The ink zone opening is adjustable for each doctor blade 4 individually with the aid of a control signal that is delivered by a non-illustrated control circuit. The fountain roller 2 can thus have a plurality of zones at the surface thereof, corresponding to the individual blades 4, at which the thickness of the ink layer can be different.

A vibrator roller 5 is oscillatingly movable between the position thereof illustrated in FIG. 1, wherein the vibrator roller 5 engages a roller 6 of the inking unit 12, and a second position thereof wherein it engages the fountain roller 2. The vibrator roller 5 is rotated, respectively, by the rollers 2 or 6 with which it is in contact. The duration of the contact with the fountain roller 2 is shorter than corresponds to a complete rotation of the vibrator roller 5, so that, during contact, the latter is covered with ink only on one part of the surface thereof. This covered portion is referred to as an ink stripe. The width thereof can be defined as an absolute in length units or, in relative terms, as a fraction of the total periphery of the vibrator roller 5. The phase of the contact with the roller 6 encompasses several rotations of the vibrator roller 5, so that the ink portion it picks up during contact with the fountain roller 2 is surrendered to the roller 6 virtually completely or at least in a percentage that is substantially equal for each period of the motion of the vibrator roller 5.

The inking unit 12 includes a large number of additional rollers with different radii, which provide for a uniform distribution of the ink on the surface thereof in the peripheral direction by rolling off on one another. Simultaneous rubbing of the ink in the axial direction of the rollers, which occurs in the inking unit, insures that the as yet abrupt transitions of the ink layer thickness between zones become fluid transitions when the ink reaches the printing plate on the plate cylinder 7.

The further construction of the printing unit with a rubber blanket cylinder 8, a rubber blanket washing device 9, an impression cylinder 10, a dampening unit 11, and so forth, is well known and, it is believed, need not be described in further detail here.

Figure 2:
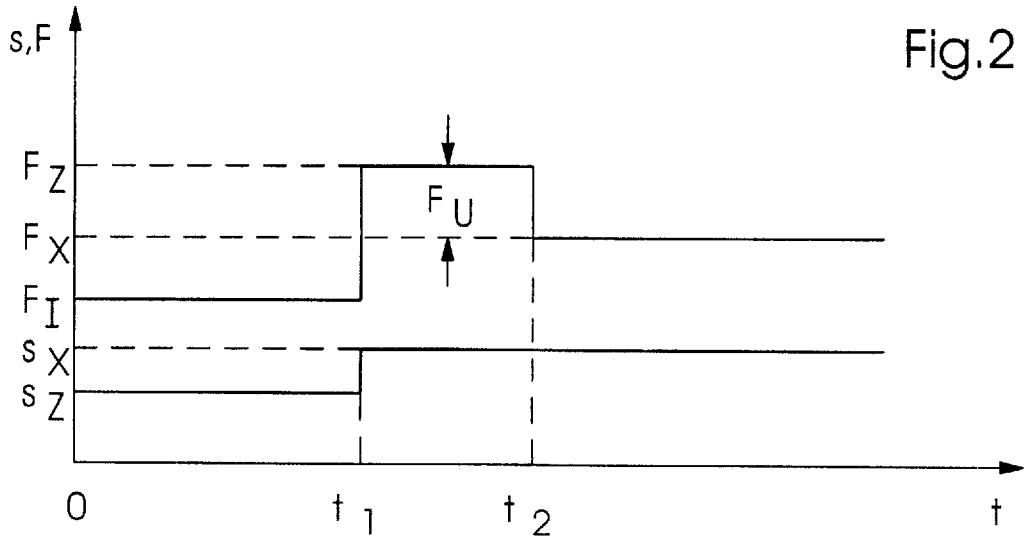
FIG. 2 is a plot diagram depicting the time rate of change of a nominal value of an ink quantity, and the size of the ink portion controlled by this nominal value.

FIG. 2 shows the time rate of change of a nominal or reference value s that is prescribed for the control circuit from outside, and the size of the ink portion F, which is transported in each movement cycle of the vibrator roller 5, that size being dependent upon this nominal value, and modifications thereof. For each nominal value, a size of the ink portion exists, which can be calculated by the control circuit or interrogated from a characteristic curve and which, for a constant nominal value, must be transported by the vibrator roller 5 in order to maintain the desired quantity of ink in the printing unit. In the time interval from 0 to $t_1$, the value $s_1$ is present at the control circuit, and the transferred ink portion is $F_I$. At the instant of time $t_1$, the nominal value changes to $s_x$, for example, because the ink quantity in the printing unit must be adapted to the ink consumption of a new print job not only in individual zones but in the entire printing unit. A new size of the ink portion $F_x$ corresponds to the new nominal value $s_x$. In dependence upon $F_x$ and $F_I$, the control circuit calculates an overelevation or increase $F_u$ of the ink portion.

According to a first mode of the method according to the invention, the control circuit modifies the width of the ink stripe on the vibrator roller so that an ink portion $F_z=F_x+F_u$ is transferred with each movement cycle. In the example at hand, $F_z-F_I=2(F_x-F_I)$; i.e. , the ink portion is overcontrolled by a factor of 2. Overcontrol factors between 1.5 and 2.5 have proven advantageous for a large range of area coverages of the printed product.

In order to increase the ink portion to $F_z$, the control circuit varies the rotation rate of the fountain roller 2. Because the relationship between the transferred ink quantity and the angle of rotation which is traversed by the fountain roller and vibrator roller in contact with one another is not exactly linear, the control circuit advantageously determines the angle of rotation that the fountain roller must traverse in contact with the vibrator drum in order to transfer the desired ink quantity, preferably using an empirically calculated characteristic curve, and controls the rate of rotation of the fountain roller in such a manner that the desired angle of rotation is traversed within the constant time that is available for the contact of the fountain roller and the vibrator roller, which is conditional to the construction of the printing unit.

At time $t_2$ the rate of rotation of the fountain roller is adjusted again, so that, from that time onward, the transferred ink portion is of a size $F_x$, which is associated with the nominal value $s_x$.

Figure 3:
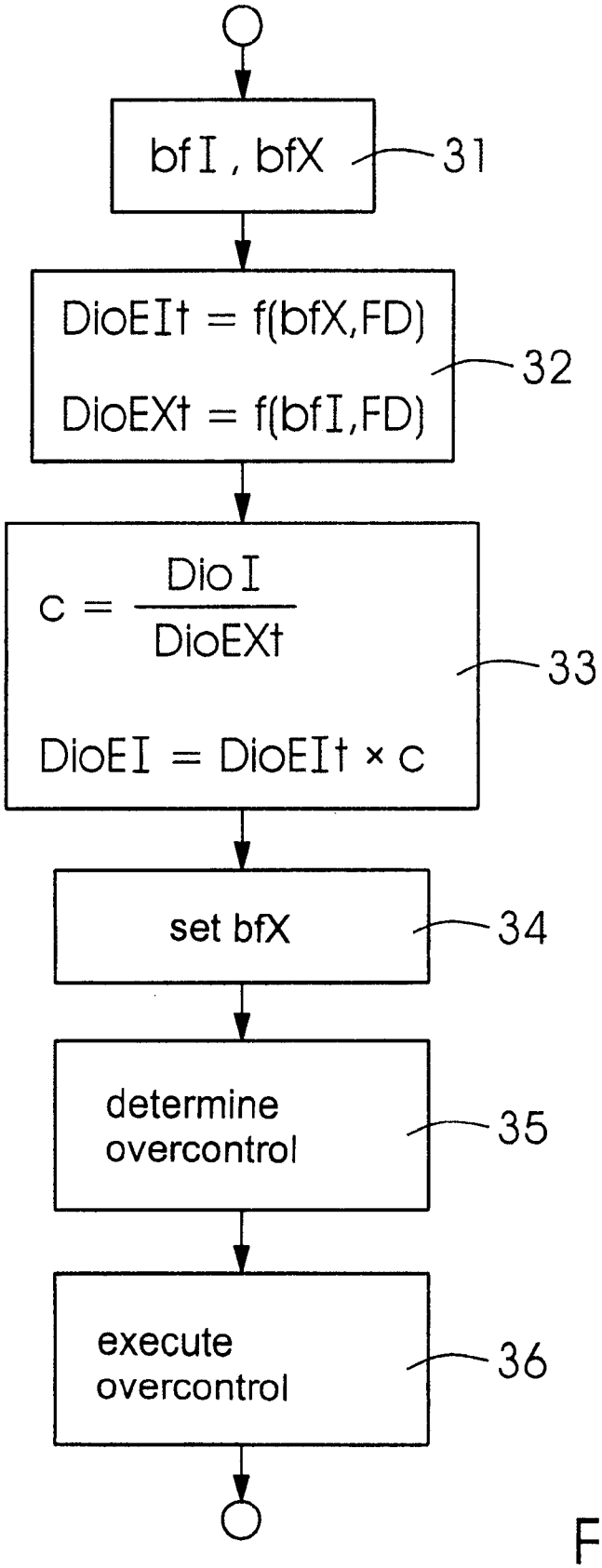
FIG. 3 is a flowchart of the steps of the inventive method.
Figure 4:
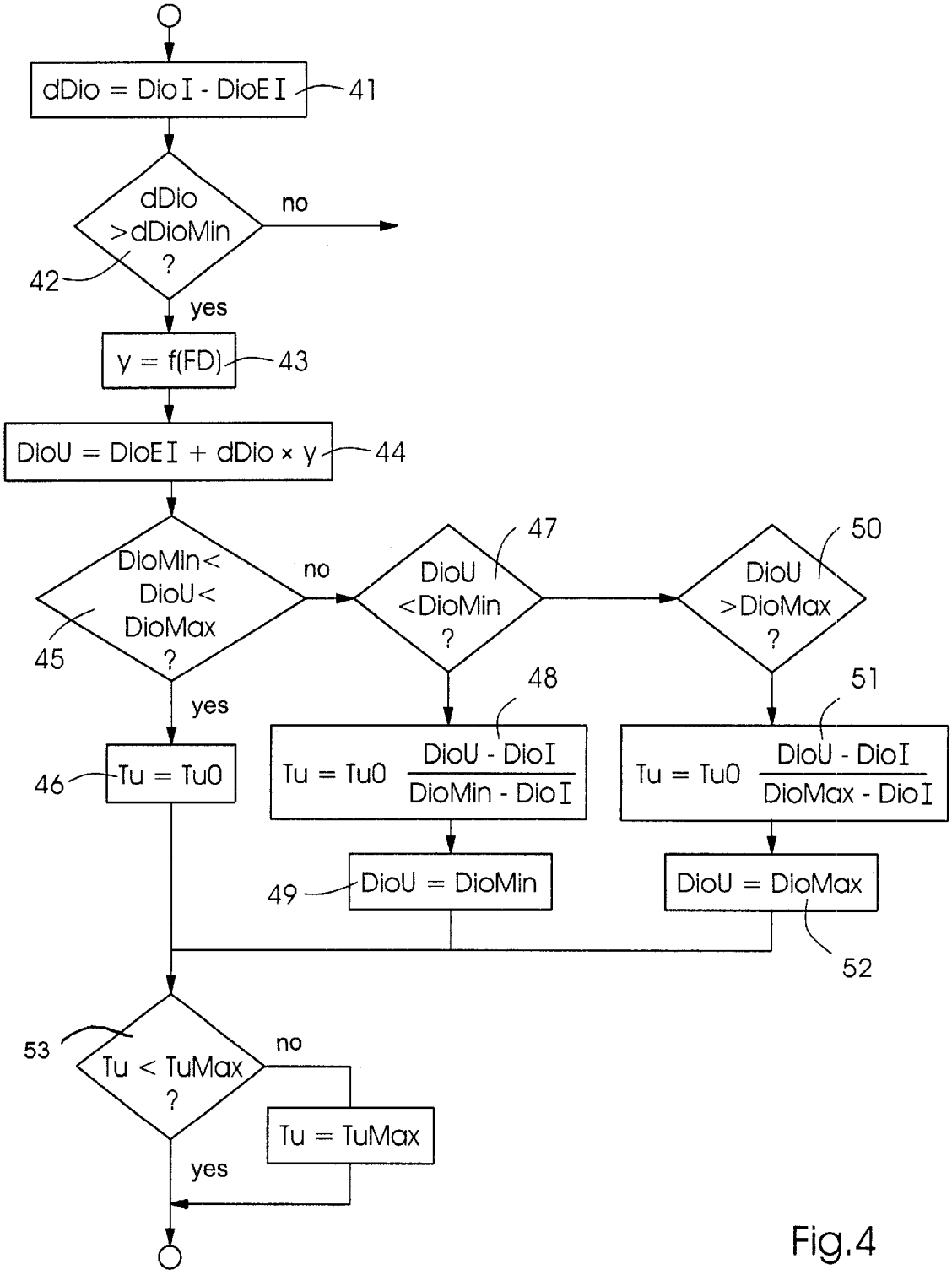
FIG. 4 is a more detailed representation of one of the steps of the flowchart of FIG. 3.

A second mode of the method according to the invention is described with the aid of the flowcharts of FIGS. 3 and 4. This mode differs from the first mode in the manner wherein the overelevation $F_u$ is proportioned. Whereas in the first mode, this is accomplished exactly like the modification of $F_I$ to $F_x$ by changing the width of the ink stripe, here the overelevation is controlled using the ink zone opening. Only one individual ink zone is considered in the description of the second mode; it is understood that the method is performed for each individual zone in a printing machine having several ink zones.

A modification of the nominal value from $s_I$ to $s_x$ as represented in FIG. 2 is again under consideration. In the time interval [0, $t_1$] an actual ink stripe width bfI and an actual ink zone opening DioI are set, and an ink portion $F_I$ is transferred. After prescribing a new nominal value $s_x$ at time $t_1$, in step 31 of FIG. 3, the control circuit first calculates the width bfZ that the ink stripe would have to have in order to transfer the ink portion $F_x$. The ink stripe width bfI that was set in the time interval [0,$t_1$] is known.

In step 32, a theoretically equivalent ink zone opening DioEIt is calculated, which gives the dimension of the ink zone opening that would have to be set in the time interval [0,$t_1$] in order to transfer the ink portion $F_I$ with the ink stripe width bfX. The calculation of $DioEI_T$ is accomplished with the aid of a family of preset ink characteristic curves which are stored in the control circuit and which indicate the ink zone opening that is theoretically required for a given ink stripe width, as a function of surface coverage.

In addition, a theoretical ink zone opening DioEXt is calculated with the aid of the same preset ink characteristic curves that give the theoretical ink zone opening for the original ink stripe width bfI.

The reason for calculating DioEXt is that the ink zone opening DioI that is actually set by a user in the time interval [0,$t_1$] for optimal ink reproduction can differ from the theoretical ink zone opening DioEXt that is obtained from the characteristic curves. It is presumed that the relationship or ratio c between an ink zone opening that is theoretically computed, using the characteristic curves, for given area coverage and ink stripe width, and the real ink zone opening is the same for all area coverages and ink stripe widths. This ratio c can thus be calculated in step 33 using the actual ink zone opening DioI in the time interval 0 to $t_1$ and the theoretical ink zone opening DioEXt:

$$c=DioI/DioEXt,$$

and the real equivalent ink zone opening DioEI is calculated from DioEIT:

$$DioEI=c\ DioEIt.$$

At the conclusion of step 33, all parameters are known which are required for the control of the ink feed adjustment: bfX, the ink stripe width that must now be set; DioI, the desired ink zone opening subsequent to the adjustment (this is the same before the adjustment is begun and after it is completed); and DioEI, the equivalent real ink zone opening. The ink stripe width is now set to the new value bfX in step 34, and this is followed by the calculation of the time characteristic of the control of the ink zone opening dependent upon the previously specified initial parameters bfX, DioEI and DioI in step 35.

The individual steps of this calculation will now be described with reference to FIG. 4. In step 41, the difference dDio between DioI and DioEI is determined. In step 42, when this is less than a limit value dDioMin, there is no overcontrol of any sort, and the ink zone opening remains at DioI. Otherwise, the procedure branches to step 43, wherein an overelevation factor y is specified with the aid of an overelevation characteristic curve dependent upon the area coverage. The prescription of the overelevation factors is discussed in greater detail hereinafter in connection with FIG. 6. In step 44, the overcontrolled ink zone opening DioU is calculated in accordance with the formula.

$$DioU=DioEI+dDio\cdot y$$

In step 45, when the calculated ink zone opening DioU lies within the interval of the actually adjustable ink zone openings [DioMin, DioMax], in step 46, the time period Tu during which the overcontrol is maintained is fixed at a standard value Tu0. In step 47, when DioU is less than DioMin, for example, because dDio is negative due to a drop in the nominal value and it cannot be set at the ink fountain, the time period Tu must be defined longer than in the previously described case. Therefore, in step 48, Tu is calculated according to the formula $$Tu=TuO(DioU-DioI)/(DioMin-DioI).$$

An analogous procedure is followed when DioU, in step 50, is greater than the maximum adjustable ink zone opening DioMax. In step 51, Tu is calculated according to the formula $$Tu=TuO(DioU-DioI)/(DioMax-DioI),$$

and DioU is then corrected to the value DioMax in step 52.

It is still possible to check, in a subsequent step 53, whether the prescribed period Tu fails to cross an upper limit TuMax and, if so, to limit the overcontrol period to TuMax.

Once the duration Tu of the overcontrol time period and the ink zone opening DioU that must be set during this time period are known, the corresponding control can be executed (note FIG. 3, step 36). The modification of the ink stripe from bfI to bfX, and the adjustment of the ink zone openings from DioI to DioU are accomplished simultaneously. At the end of the overcontrol period Tu, the ink zone opening DioI is adjusted again, and the new ink stripe width bfX is retained.

Figure 5A:
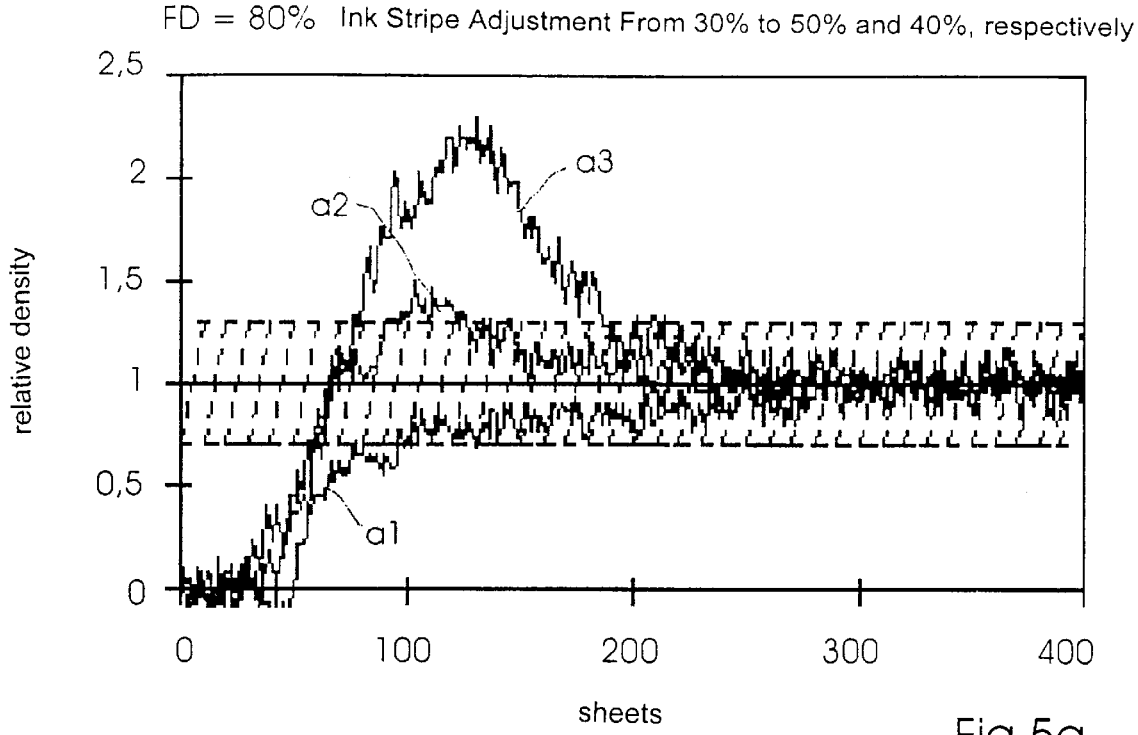
FIGS. 5*a* and 5*b* are plot diagrams depicting the time rate of change, represented by the number of sheets that have been printed, of the ink thickness of the printed sheets in the course of printing processes which are controlled in accordance with various methods.
Figure 5B:
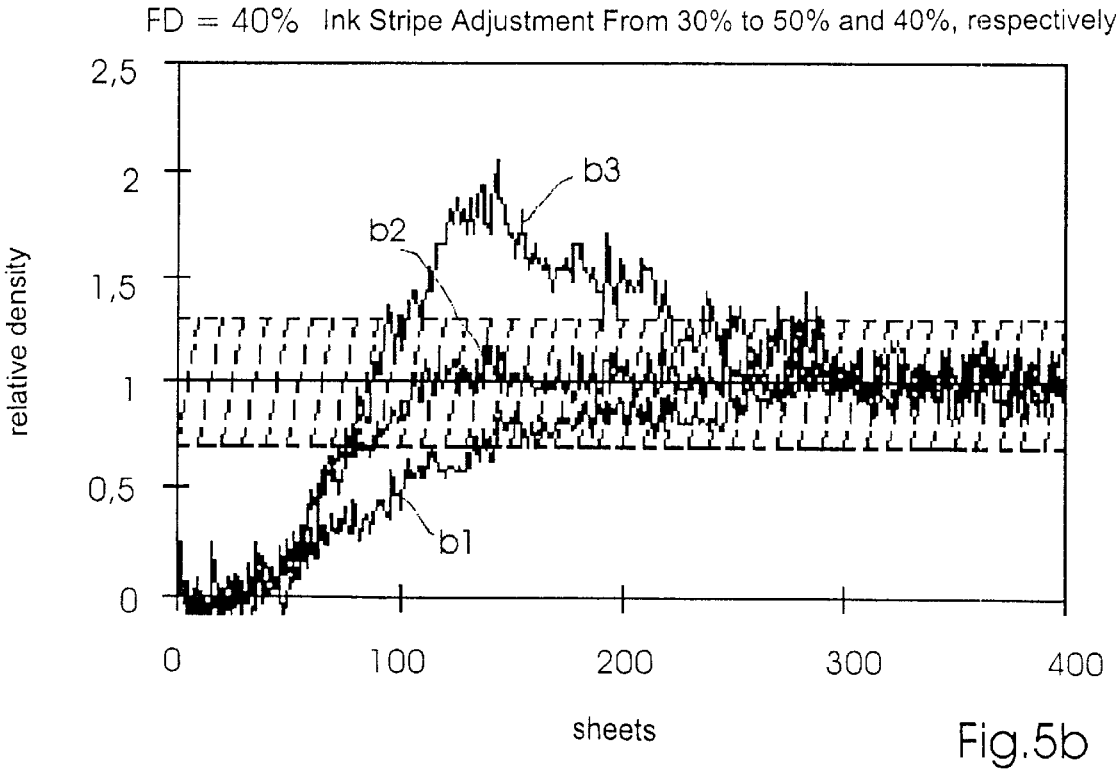

FIGS. 5*a* and 5*b* show two examples of the time characteristic or time rate of change of the ink thickness of printed sheets, for an adjustment of the ink stripe width, once in a conventional manner without overcontrol, and again with overcontrol by a factor of two and four, respectively, in accordance with the invention, the overcontrol having been performed by temporarily increasing the width of the ink stripe in accordance with the first alternative of the method. What was measured was the respective total hue density at the start of the printing of a sheet. In order to make the measurement results easier to compare, the density modification has been normalized to 1, and the lesser of the two densities has been assigned the value 0, and the greater of the two densities, the value 1, respectively.

A first measurement was performed with an area coverage FD=80%. In this regard, an O.K. sheet was first printed with a density ratio DV=1.50, for an ink stripe width of bf=30%. The curve al from FIG. 5 shows the density values obtained in a printing of 400 sheets subsequent to an elevation of the ink stripe width to bf=50%. Subsequent to the preparation of the O.K. sheet with an ink stripe width of bf=30%, in a second measurement sequence, the ink stripe width was raised to bf=70% for 40 sheets, and then 400 sheets were printed with an ink stripe width of bf=50%. This corresponds to a twofold overcontrol of the ink stripe width during a transition period wherein the 40 sheets were printed. The curve a2 shows the measurement results. In a third measurement sequence, as in the second, an O.K. sheet was first prepared with DV=1.50 for an ink stripe width of bf=30%, and then, for 40 sheets, the ink stripe width was raised to bf=70%. Next, the ink stripe width was reduced to bf=40%, and 400 sheets were printed at this setting. The overcontrol factor here was equal to 4. The measurement result is represented in the curve a3.

In the conventional control process of curve a1, some 100 sheets are needed before the relative density reaches the tolerance interval [0.7; 1.3] about the target value 1. With the overcontrol in the curves a2 and a3, only approximately 60 sheets are needed, respectively. The curve a3 shows a clear overshoot in the region between approximately 90 to 180 sheets; the curve a2 corresponding to twofold overcontrol shows an overshoot that is considerably smaller but yet only slightly exits the tolerance interval.

FIG. 5*b* shows the results of an analogous measurement sequence which was performed under the same conditions as in the case of FIG. 5*a* except that the surface density was FD=40% instead of 80%. As a result of the lower ink consumption, the number of sheets that are printed before reaching the tolerance interval is greater than in the previous case, being approximately 110 for conventional control (curve b1), and approximately 70 sheets for the overcontrol (curves b2, b3) in accordance with the method of the invention. The overshoots are smaller than in the example previously considered.

For area coverages of from 30 to 100%, overelevation factors of between 2.5 and 1.5 yield good results. Because the area coverages of the printing copy are usually not known in advance in most situations of application, or they vary in different zones of the printing copy, a fixed overcontrol factor in the range from 2.5 to 1.5 must be preselected particularly when the overcontrol is achieved by controlling the ink stripe width and therefore is necessarily uniform for the entire printed image. By contrast, when the overcontrol is performed in zones by controlling the ink zone opening, as according to the flowcharts of FIGS. 3 and 4, it is then also possible to prescribe the overcontrol factor for each zone individually, depending upon the area coverage prevailing thereat.

We claim:

1. A method for controlling an ink quantity in an inking unit of a printing machine by a predetermined nominal value, using a vibrator roller oscillating between a fountain roller and the inking unit, and picking up an ink portion and surrendering the ink portion to the inking unit with which the vibrator roller is in contact, comprising the steps of:

adjusting the size of the ink portion by varying the width of an ink stripe on the vibrator roller, the size being adjusted for a modification in the nominal value, from a size ($F_I$) corresponding to the nominal value prior to modification, to at least one intermediate size ($F_z$) lying beyond a size ($F_x$) corresponding to the modified nominal value and, subsequent to the expiration of a transition time interval ($[t_1,t_2]$), adjusting the size of the ink portion from the at least one intermediate size ($F_z$) back to the size ($F_x$) thereof corresponding to the modified nominal value.

2. The method according to claim 1, wherein a difference ($F_u$) between the at least one intermediate size ($F_z$) and the size ($F_I$) corresponding to the nominal value prior to the modification thereof is proportional to a difference between the size ($F_I$) corresponding to the nominal value prior to modification thereof and the size ($F_x$) corresponding to the modified nominal value.

3. The method according to claim 2, wherein the proportionality factor is between 1.5 and 2.5.

4. The method according to claim 1, wherein the step of adjusting the ink portion between the at least one intermediate size ($F_z$) and the size ($F_x$) corresponding to the modified nominal value further comprises modifying the width of the ink stripe.

5. The method according to claim 4, wherein the step of modifying the width of the ink stripe comprises modifying the duration of contact between the fountain roller and the vibrator roller.

6. The method according to claim 4, wherein the step of modifying the width of the ink stripe comprises modifying the rate of rotation of the fountain roller.

7. The method according to claim 1, wherein the step of adjusting the ink portion between the at least one intermediate size ($F_z$) and the size ($F_x$) corresponding to the modified nominal value further comprises modifying the thickness of the ink layer on the ink stripe.

8. The method according to claim 7, which includes zonally controlling the thickness of the ink on the ink stripe.

9. The method according to claim 8, which includes zonally prescribing the ratio of the difference between the at least one intermediate size ($F_z$) and the size ($F_I$) corresponding to the nominal value prior to the modification, to the difference between the size ($F_I$) corresponding to the nominal value prior to modification and the size ($F_x$) corresponding to the modified nominal value.

10. The method according to claim 9, which includes prescribing the ratio to be smaller as an area covered by a zone being controlled becomes larger.

* * * * *